United States Patent [19]

Jäckering

[11] Patent Number: 4,747,550

[45] Date of Patent: May 31, 1988

[54] GRINDING MILL WITH MULTIPLE MILLING SECTIONS

[75] Inventor: Günther Jäckering, Hamm, Fed. Rep. of Germany

[73] Assignee: Altenburger Maschinen Jäckering GmbH, Hamm, Fed. Rep. of Germany

[21] Appl. No.: 863,935

[22] Filed: May 16, 1986

[30] Foreign Application Priority Data

Dec. 7, 1985 [DE] Fed. Rep. of Germany ..... 3543370

[51] Int. Cl.[4] ..... B02C 23/24

[52] U.S. Cl. ..... 241/55; 241/56; 241/52; 241/162; 241/185 A; 241/188 R; 241/189 R; 241/291

[58] Field of Search ..... 241/55, 56, 57, 58, 241/161, 162, 163, 185 A, 186 A, 188 R, 189 R, 195, 291, 292.1

[56] References Cited

U.S. PATENT DOCUMENTS 2,561,388 7/1951 Lykken et al. ..... 241/58 X 2,752,097 6/1956 Lecher ..... 241/58 X

*Primary Examiner*—Timothy V. Eley

*Attorney, Agent, or Firm*—Spencer & Frank

[57] ABSTRACT

A grinding mill containing a plurality of milling sections and composed of: a single cylindrical stator common to all milling sections; a rotor mounted in the stator for rotation about the longitudinal axis of the stator and having a plurality of milling plates spaced apart along the longitudinal axis and each disposed in a respective milling section; and a blower facility fastened to the rotor for rotation therewith and disposed near the bottom of the stator below the lowermost milling section for conveying material to be ground and conveyor gas through a central opening in the bottom of the stator to the milling sections. An auxiliary flow inducing device is connected to the outlet of the mill. The mill further includes a finger sifter mounted adjacent the outlet end of the milling sections and rotated at a rate selected independently of the rate of rotation of the rotor. Each milling plate can be formed to have an irregular working surface.

14 Claims, 2 Drawing Sheets

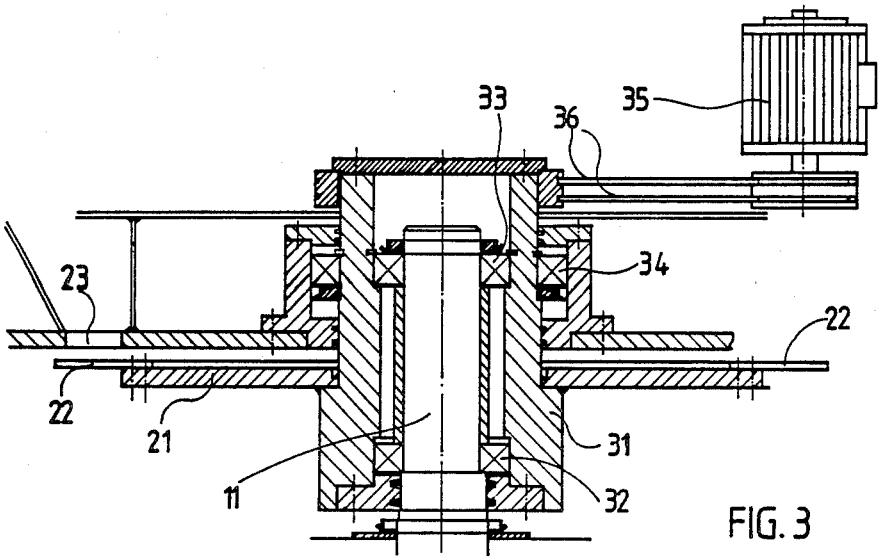
FIG. 3
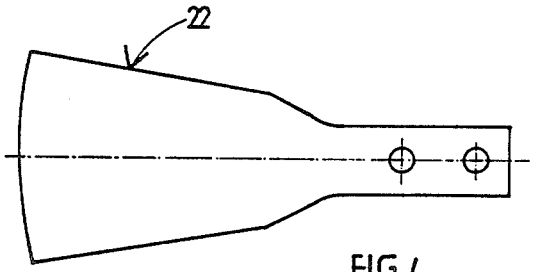
FIG.4
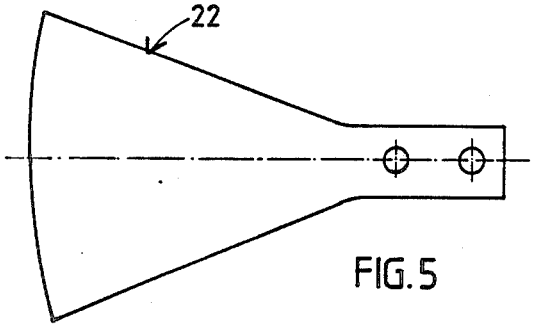
FIG.5
FIG.6
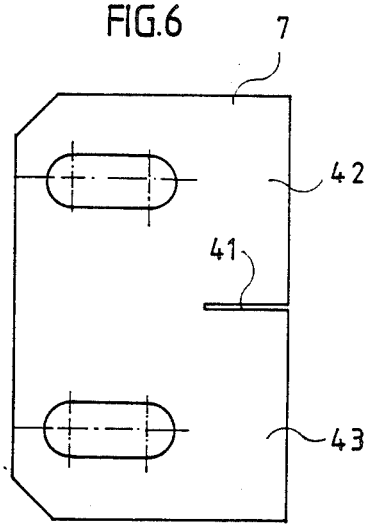
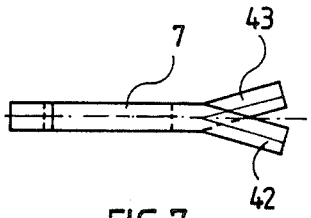
FIG.7

GRINDING MILL WITH MULTIPLE MILLING SECTIONS

The invention concerns a grinding mill with multiple milling sections which consists essentially of a single cylindrical stator common to all milling sections, of a rotor which carries the individual milling plates vertically arranged in several milling sections, and of a blower facility for the conveyor gas which carries the material to be pulverized through the grinding mill.

A grinding mill of this type is described in the prospectus "Ultra Rotor" of the company Altenburger Maschinen. The pulverizing actions of this mill which uses air as conveyor gas depends largely on the interaction of the material particles with each other as they are accelerated to high velocities by air eddies caused by the rotating milling plates. These induced collisions with each other cause the particles to break up. Only a minor fraction of the pulverizing process is caused by an interaction of the material particles with the stationary or rotating machine elements. It is due to this dominating interaction of the particles with each other in the air current that a particularly gentle treatment of the material to be pulverized is achieved.

This pulverizing technique has been particularly successful for pulverizing temperature sensitive materials. Since the material is continuously within turbulent air currents, the heat inevitably generated by the pulverizing process is immediately removed. At the same time, any moisture present in the material is also removed, thus achieving an intense dehumidification of moist materials.

The prospectus mentioned above shows that particular attention should be given to a control of air current in grinding mills of this type. An adequate air current must be ensured to prevent both the overheating of the material as well as that of the machine.

The present invention has the objective to create a grinding mill of the above mentioned type where an adequate air supply is ensured at all times. In addition, an increase of the throughput power of the grinding mill is achieved.

The objective is reached by the invention by employing a gas transport facility at the input end of the milling sections. It is the gas transport facility at the input end of the milling sections that prevents operating conditions with an inadequate air supply and, thereby, prevents overheating.

A favourable development of the invention is characterized by the fact that the gas transport facility has a central input port for gas and material insertion as well as a radially located gas and material output port. The advantage of this solution is that the material to be pulverized is already well distributed on the circumference of the mill before it enters the actual milling sections. Thus, the disadvantages of usual mills, where the material enters the mill from a single tangential location at the outer radius causing a considerably one-sided load on the machine elements, are alleviated.

It has been shown to be particularly advantageous for the gas transport facility to be designed as a single stage radial blower with the blower wheel mounted on the rotor shaft directly beneath the first milling section. Radial blowers of this type have a particularly high air transport capability. Surprisingly it turned out that a radial blower wheel is also well suited for tranporting non-gaseous material from the axially located input to the radially located exit, thereby uniformly distributing the material on the circumference of the mill, i.e., directly at the entrance ports of the first milling sections.

Further advantages and the particulars of the invention shall be demonstrated with the application example as shown in FIGS. 1 through 7.

BRIEF DESCRIPTION OF THE DRAWING

FIG. 3 is a cross-sectional detail view of a modified portion of the embodiment of FIG. 1.

FIGS. 4 and 5 are plan views of alternate embodiments of another component fo the embodiment of FIG. 1.

FIG. 6 is a side view of an embodiment of a further component of the device of FIG. 1.

FIG. 7 is an end view of the component shown in FIG. 6.

DESCRIPTION OF THE PREFERRED EMBODIMENTS

Figure 1:
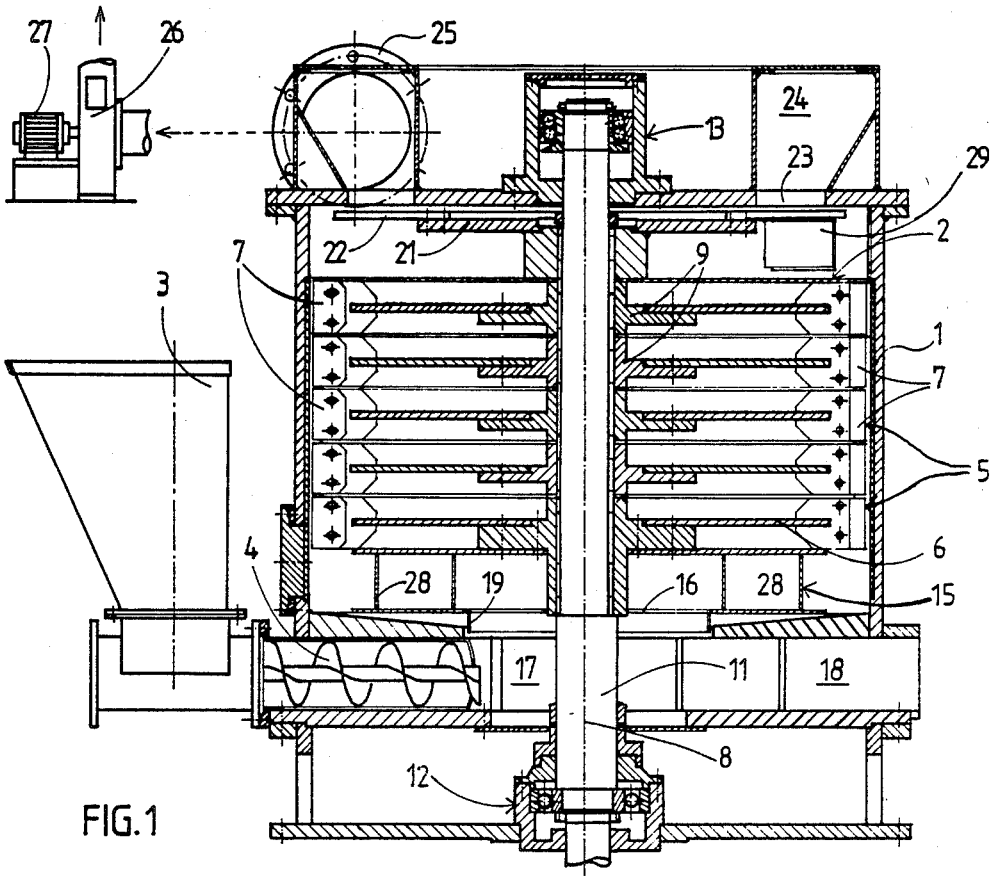
FIG. 1 is an elevational, cross-sectional view of a preferred embodiment of a mill according to the invention.
Figure 2:
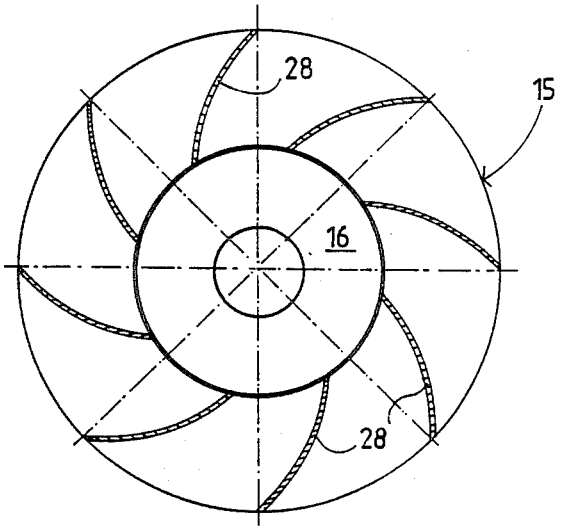
FIG. 2 is an axial, cross-sectional view of a component of the device of FIG. 1.

In case of the grinding mill shown in FIG. 2, the stator or stator housing is specified as 1, the rotor generally as 2, the feed funnel (hopper) as 3 and the feed screw as 4.

The mill is equipped with five vertically superpositioned milling sections 5. Each milling section consists of a multitude (e.g. around 50) of milling plates 7 that are mounted an the outer radius of a circular plate 6. The milling plate 7 extend radially and axially with respect to the rotational axis 8 of the rotor.

The discs 6 which carry the milling plates 7 are mounted to the hub flanges 9 which themselves are connected to the shaft 11 of the rotor 2. The shaft 11 is born in bearings 12 and 13 at the bottom and top of the rotor 2. The drive (not shown) is located below the bottom bearing 12.

A radial blower wheel 15 is additionally mounted to the rotor shaft 11 such that it is directly beneath the first milling section 5. Its axially located inlet 16 is directed downward into a space 17 into which open both the feed channel of the material with the feed screw 4 and the air supply channel 18. For a better distribution of the material and the air while it enters the blower wheel 15, a rim 19 surrounding the inlet 16 is added; it extends perpendicular to the plane of the wheel 15 into the centrally located space 17.

At the top of the milling sections 5, a disc 21 is mounted to the shaft 11 on whose circumference the sifter fingers 22 are mounted. Located above the sifter fingers 22 is an essentially ring shaped opening 23 followed by a ring channel 24 and the exit port 25. The exit port 25 opens either directly or through a separator (not shown) to the ventilator 26 whose drive motor is specified as 27.

FIG. 2 is another view of the blower wheel showing a total of eight backward curved blades 28.

During operation of the grinding mill, the material and the amount of air required both for transport and milling enter space 17 and from there in axial direction to the central opening of the blower wheel 15. Inside the blower wheel 15 rotating at high speed, the material and air are set into rotation and are transported radially outward. This results in a uniform distribution of the material on the inner wall of the stator followed by a likewise uniform rising of the material through the individual grinding sections 5. At the same time, the blower wheel 15 has a pulverizing effect, i.e., clumps possibly present in the material to be pulverized are already crushed. The material and air are transported through the grinding sections 5. Sufficiently finely ground material is then able to be air-carried through the finger sifter 22. The mixture of material and air passes through channel 24 and leaves the grinding mill through exit port 25; material and gas are separated from each other in subsequent separators (not shown). Material held back by the finger sifter 22 leaves the mill through an overflow port 29 and is fed back into the material entrance port.

In the grinding mill as shown, the blower wheel 15 and the ventilator 26 both influence the speed of the gas and, thereby, the transport of the material through the mill. The conveying power of the blower 15 depends on the rotational speed of the rotor 2 and is constant with a constant rotor speed. In a favourable development of the invention, the speed of the motor 27 and, thereby, the conveying power of the ventilator 26 is variable; the residence time of the material in the milling sections 5 can, thus, be influenced. Furthermore, different gas transport conditions depending on many characteristics of the material, e.g. its specific weight, can easily be adjusted for by a variable speed ventilator 26.

In case that a material has a high specific weight, the upper ventilator 26 is set to a high conveying velocity thus ensuring a proper transport of the heavy material through the mill.

If, on the other hand, the material is damp and should be dried during the process of pulverization, it is best to slow down the upper ventilator 26. This increases the residence time of the material-air mixture in th grinding mill such that the required dehumidification during pulverization is achieved. The dehumidification can be increased further by supplying hot air to the air supply channel 18 of the mill 1.

In the case of materials that are difficult to pulverize, e.g., fibrous material, the upper ventilator 26 is also kept at a slow speed to ensure the proper pulverization effect.

In the case of materials that require an extremely gentle pulverization, low temperatures are required. This can be achieved by a high air current. In applications of this sort, the transport velocity is increased by increasing the speed of the upper ventilator 26.

Within the framework of this invention, it is furthermore advantageous to install a separate drive for the finger sifter located at the top of the rotor 2 such that the rotational speed of the sifter fingers can be controlled independently from the speed of the rotor 2. This measure not only enables influencing the grain size of the material; it also allows adjusting the pulverization procedure to the individual material characteristics. For instance, if a product with low specific weight should be pulverized to an extreme fineness at the same time ensuring an extremely gentle treatment, then a high air current and a particularly high rotary speed of the finger sifter is required. The high air current keeps the temperature of the material low. On the other hand, a high air current causes the material to flow through the mill at a high speed such that it is not sufficiently pulverized. A high rotational speed of the finger sifter, then, keeps the material from leaving the mill. It is then led back to the material insertion port for further processing. In the interim period (grinding pause) the material can cool off further before being again subjected to the grinding process.

FIG. 3 shows an application with a separate drive for the finger sifter. Here, a sleeve 31 is mounted for free rotation in bearings 32 and 33 at the top end of the shaft 11 of the partially shown mill 1. An additional support bearing 34 is required between the outside of the sleeve 31 and the mill housing. The sleeve 31 can, thus, rotate freely and independently of the rotating shaft 11.

The lower end of sleeve 31 reaches into the mill housing carrying the disc 21 with the sifter fingers 22. The upper end passes through the mill housing, sealing off the interior by otherwise unspecified gaskets. On the outside of the mill housing the sleeve extends far enough such that it can be coupled via the drive belt 36 to a variable speed drive motor 35.

The sifter fingers 22 are usually rod shaped. Due to their radial arrangement, the gap between adjacent rods increases in radial direction. In order to achieve a largely uniform gap size in radial direction, the invention proposes to use sifter fingers whose width increase in radial direction. Examples for this are shown in FIGS. 4 and 5. Using sifter fingers of this type positively influences the separating effect, e.g., a more uniform separation of particles is achieved.

FIGS. 6 and 7 show a greatly improved design of the milling plates 7. In the middle of its working surface it shows a cut 41. Above and below this cut, the adjacent sections 42 and 43 are bent in opposite directions. Milling plates of this type show a surprising improvement with regard to grinding efficiency. The eddies of the air-material-mixture inside the milling gap are broken up by this measure, thus greatly improving the pulverization effect.

I claim:

1. In a grinding mill, which grinding mill includes a cylindrical stator having an inner wall and a rotor rotatable relative to the stator and having a plurality of milling plates each having a working surface facing the inner wall of the stator, the improvement wherein at least one said milling plate is provided with a cut extending perpendicular to the working surface and dividing the working surface into two parts, and the two parts of the working surface are bent in respectively opposite directions to constitute means for breaking up eddies of material being ground during operation of said mill.

2. A grinding mill containing a plurality of milling sections and comprising: a single cylindrical stator common to all milling sections and having a top, a bottom provided with a central opening, and a longitudinal axis which is substantially vertical when said mill is in operation; a rotor mounted in said stator for rotation about the longitudinal axis and having a plurality of milling plates extending parallel to the longitudinal axis and disposed in respective milling sections; material supply means disposed for delivering material to be ground to the region beneath said central opening; gas supply means disposed for delivering conveyor gas to the region beneath said central opening; and a blower facility including a single stage radial blower fastened to said rotor for rotation therewith and disposed near the bottom of said stator below the lowermost milling section for conveying material to be ground and conveyor gas from the region beneath said central opening to said milling sections, characterized by the fact that the blower facility has a central gas and material entrance part and a radial gas and material exit port, and the radial blower (15) has a rim (19) which extends perpendicular to the plane of the blower and which delimits the central entrance port of said facility.

3. A grinding mill containing a plurality of milling sections and comprising: a single cylindrical stator common to all milling sections and having a top, bottom provided with a central opening, and a longitudinal axis which is substantially vertical when said mill is in operation; a rotor mounted in said stator for rotation about the longitudinal axis and having a plurality of milling plates extending parallel to the longitudinal axis and disposed in respective milling sections; material supply means disposed for delivering material to be ground to the region beneath said central opening; gas supply means disposed for delivering conveyor gas to the region beneath said central opening; and a blower facility including a single stage radial blower fastened to said rotor for rotation therewith and disposed near the bottom of said stator below the lowermost milling section for conveying material to be ground and conveyor gas from the region beneath said central opening to said milling sections, characterized by the fact that the throughput velocity of the mill is controllable by a gas transport facility (26) installed in series behind the milling sections (5) and designed as a ventilator with a variable speed motor drive (27).

4. A grinding mill containing a plurality of milling sections and comprising: a single cylindrical stator common to all milling sections and having a top, a bottom provided with a central opening, and a longitudinal axis which is substantially vertical when said mill is in operation; a rotor mounted in said stator for rotation about the longitudinal axis and having a plurality of milling plates extending parallel to the longitudinal axis and disposed in respective milling sections, material supply means disposed for delivering material to be ground to the region beneath said central opening; gas supply means disposed for delivering conveyor gas to the region beneath said central opening; and a blower facility including a single stage radial blower fastened to said rotor for rotation therewith, carrying a number of backward curved blades, and disposed near the bottom of said stator below the lowermost milling section for conveying material to be ground and conveyor gas from the region beneath said central opening to said milling sections.

5. Grinding mill in accordance with claim 4 characterized by the fact that the blower facility has a central gas and material entrance port and a radial gas and material exit port.

6. Grinding mill in accordance with claim 4 characterized by the fact that the throughput velocity of the mill is controllable by a gas transport facility (26) installed in series behind the milling sections (5).

7. A grinding mill containing a plurality of milling sections and comprising: a single cylindrical stator common to all milling sections and having a longitudinal axis which is substantially vertical when said mill is in operation; a rotor mounted in said stator for rotation about the longitudinal axis and having a plurality of milling plates each extending parallel to the longitudinal axis, each milling plate having a working surface disposed in a respective milling section; and a blower facility for conveying material to be ground and conveyor gas to said milling sections; wherein at least some of said milling plates are provided with a cut extending perpendicular to the working surface and dividing the working surface into two parts, and the two parts of the working surface are bent in respectively opposite directions to constitute means for breaking up eddies of the material and conveyor gas during grinding.

8. A grinding mill containing a plurality of milling sections and comprising: a single cylindrical stator common to all milling sections and having a top provided with an exit port, a bottom provided with an inlet port, and a longitudinal axis which is substantially vertical when said mill is in operation; a rotor mounted in said stator for rotation about the longitudinal axis and having a plurality of milling plates each extending parallel to the longitudinal axis and disposed in respective milling sections; material supply means disposed for delivering material to be ground to the inlet port; gas supply means disposed for delivering conveyor gas to the inlet port; a blower facility for conveying material to be ground and conveyor gas from the inlet port opening to said milling sections; a finger sifter rotatably mounted in said housing between said milling sections and said exit port for rotation relative to said rotor and for sifting material after passage through said milling sections; and independent drive means coupled to said sifter for rotating said sifter at a rate selected independently of the rate of rotation of said rotor.

9. Grinding mill in accordance with claim 8, characterized by the fact that the rotational speed of the drive means (35) is variable.

10. Grinding mill in accordance with claim 8, characterized by the fact that the drive means of the finger sifter (21, 22) consists of a variable speed transmission motor.

11. Grinding mill in accordance with claim 8, characterized by the fact that the finger sifter (21, 22) is connected to a sleeve (31) which is mounted on the rotor (11) for free rotation (bearings 32, 33) and is supported by a bearing (34) carried by the stator of the grinding mill (1).

12. Grinding mill in accordance with claim 11 wherein said sleeve has a portion which is exterior to said milling sections and which is coupled to said drive means.

13. Grinding mill in accordance with claim 8 characterized by the fact that the width of the sifter fingers (22) increases in the radial direction.

14. Grinding mill in accordance with claim 13, characterized by the fact that the width of the sifter fingers (22) increases in the radial direction such that the slot created by two adjacent sifter fingers (22) has an approximately constant width.

* * * * *